US011846069B2

(12) United States Patent
Olsson

(10) Patent No.: US 11,846,069 B2
(45) Date of Patent: Dec. 19, 2023

(54) REFINER SEGMENT

(71) Applicant: VALMET AB, Sundsvall (SE)

(72) Inventor: Åke Olsson, Deje (SE)

(73) Assignee: VALMET AB, Sundsvall (SE)

( * ) Notice: Subject to any disclaimer, the term of this patent is extended or adjusted under 35 U.S.C. 154(b) by 480 days.

(21) Appl. No.: 15/734,295

(22) PCT Filed: May 2, 2019

(86) PCT No.: PCT/SE2019/050388
§ 371 (c)(1),
(2) Date: Dec. 2, 2020

(87) PCT Pub. No.: WO2019/235987
PCT Pub. Date: Dec. 12, 2019

(65) Prior Publication Data

US 2021/0222364 A1 Jul. 22, 2021

(30) Foreign Application Priority Data

Jun. 4, 2018 (SE) ..... 1850674-1

(51) Int. Cl.
*D21D 1/00* (2006.01)
*D21D 1/30* (2006.01)
*B02C 7/12* (2006.01)

(52) U.S. Cl.
CPC ..... *D21D 1/306* (2013.01); *B02C 7/12* (2013.01)

(58) Field of Classification Search
CPC ..... D21D 1/30; D21D 1/303; D21D 1/306; D21D 1/008; B02C 7/12
See application file for complete search history.

(56) References Cited

U.S. PATENT DOCUMENTS 3,125,306 A 3/1964 Kollberg et al.
3,323,733 A * 6/1967 Brown, Jr. ..... D21D 1/30 241/261.2
3,473,745 A * 10/1969 Soars, Jr. ..... D21D 1/30 241/298

(Continued)

FOREIGN PATENT DOCUMENTS

CN 101654888 A 2/2010
CN 201713720 U 1/2011

(Continued)

*Primary Examiner* — Faye Francis
(74) *Attorney, Agent, or Firm* — Foley & Lardner LLP

(57) ABSTRACT

A refiner segment for refining lignocellulosic material, has a surface including a plurality of bars extending along a direction between an inner periphery of the refiner segment and an outer periphery of the refiner segment, and a plurality of dams, each of the plurality of dams extending between a corresponding pair of adjacent bars among the plurality of bars, wherein at least one of the plurality of dams is a three-dimensionally extending body including three sides, the three-dimensionally extending body extends between the corresponding pair of adjacent bars and includes a curved side, forming one of the three sides, facing the inner periphery of the refiner segment, the curved side having a concave curvature with regard to the inner periphery to thereby form a rounded section in an area defined by the at least one of the plurality of dams and the corresponding pair of adjacent bars.

9 Claims, 8 Drawing Sheets

(56) References Cited

U.S. PATENT DOCUMENTS 3,674,217 A * 7/1972 Reinhall ..... D21D 1/30 241/296
4,253,613 A * 3/1981 Reinhall ..... D21D 1/30 241/43
5,439,183 A * 8/1995 Virving ..... B02C 7/12 241/261.3
5,492,548 A 2/1996 Wasikowski
5,823,453 A * 10/1998 Garasimowicz ..... D21D 1/306 241/261.3
6,325,308 B1 * 12/2001 Lofgren ..... B02C 7/12 241/261.3
6,402,071 B1 * 6/2002 Gingras ..... D21D 1/306 241/261.3
6,938,843 B2 * 9/2005 Johansson ..... D21D 1/303 241/34
7,191,967 B2 * 3/2007 Vuorio ..... D21D 1/306 241/261.3
7,300,540 B2 * 11/2007 Sabourin ..... D21B 1/02 241/261.3
9,604,221 B2 * 3/2017 Gingras ..... B02C 7/12
9,708,765 B2 * 7/2017 Gingras ..... D21D 1/306
11,566,374 B2 * 1/2023 Lindblom ..... D21D 1/306
2002/0070303 A1 * 6/2002 Johansson ..... B02C 7/12 241/261.3
2007/0210197 A1 * 9/2007 Carpenter ..... B02C 7/12 241/298
2008/0296419 A1 * 12/2008 Gingras ..... D21D 1/306 241/261.3
2010/0270411 A1 * 10/2010 Vuorio ..... D21D 1/22 241/245
2010/0314476 A1 * 12/2010 Vuorio ..... D21D 1/22 241/291
2012/0018549 A1 1/2012 Gingras
2013/0270377 A1 * 10/2013 Gingras ..... D21D 1/306 241/220
2019/0264389 A1 * 8/2019 Gingras ..... D21D 1/306

FOREIGN PATENT DOCUMENTS

CN 201843008 U 5/2011
WO WO 95/00245 A1 1/1995
WO WO 2008/098153 A1 8/2008
WO WO 2009/040477 A1 4/2009
WO WO 2009/136846 A1 11/2009

* cited by examiner

REFINER SEGMENT

TECHNICAL FIELD

The proposed technology generally relates to a refiner segment for a refiner of lignocellulosic material. It relates more specifically to a refiner segment comprising bars and dams, a refiner disc of a refiner comprising such a refiner segment and a refiner comprising a refiner disc equipped with a refiner segment comprising bars and dams.

BACKGROUND

A commonly used refiner of e.g., lignocellulosic material comprises two relatively rotating discs between which the material is refined or defibrated. The pair of relatively rotating discs may in particular comprise one rotating disc, referred to as a rotor, and a static disc, referred to as a stator. These discs, or at least one of them, are often provided with segments, referred to as refiner segments, whose purpose is obtain a more efficient refining of the material. A specific type of refiner segments are provided with a set of bars and dams. The bars are radially extending and protruding structures that are arranged on the active surface of the segment, i.e., the surface of the segment over which the material flows, and are mainly used to achieve an efficient refining of the lignocellulosic material. The dams are also protruding structures provided on the active surface of the refiner segment, but they are not generally provided in a radial direction. The dams are instead provided on the refiner segment in such a way that a particular dam contacts, or connects, two neighboring bars. That is, a dam is provided so that it spans over a direction that connects two adjacent bars. The direction may be approximately orthogonal to the bars but it can also be provided at an angle with regard to the radial direction. A particular purpose with the dams is to lift the material that flows in the area between the bars in an upward direction, towards a disc gap defined as the gap between two opposing refiner discs, e.g., the disc gap between a rotor and a stator or the disc gap that separates the two relatively rotating discs. It is in the disc gap between the discs that the material is refined or defibrated. In the common case where each bar connects to one or several dams, a natural consequence of the geometry is that a number of partially enclosed or bounded areas are created between adjacent bars. The main part of the refining material will flow in these areas.

A particular problem associated with refiner segments equipped with bars and dams is that the bars and dams, being structures protruding from the surface of the refiner segment, will be worn down due to the abrasive contact they have with the material to be refined. The efficiency of the refiner segment will as a consequence decrease over time and there will be a need to replace the refiner segment in order to achieve a satisfactory quality of the refined material, e.g., pulp. The proposed technology aims to provide mechanisms that at least alleviate some of the problem that are associated with the wear experienced by refiner segments that are provided with bars and dams.

SUMMARY

It is an object to provide a refiner segment having improved robustness against wear caused by material flow on the refiner segment.

It is a particular object to provide a refiner segment having features that make the dams provided on the refiner segment more resilient against the wear caused by material flow.

It is an additional object to provide a refiner disc comprising a refiner segment that has improved resilience against wear caused by materials flow.

It is yet another object to provide a refiner comprising a refiner disc with improved refiner segments.

These and other objects are met by embodiments of the proposed technology.

According to a first aspect, there is provided a refiner segment for refining of lignocellulosic material. The refiner segment have a surface comprising a plurality of bars extending along a direction between an inner periphery of the refining segment and an outer periphery of the refining segment, and a plurality of dams, each of the dams extending between a corresponding pair of adjacent bars. At least one of the dams is a three-dimensionally extending body comprising three sides, the three dimensionally extending body extend between the corresponding pair of adjacent bars and comprises a curved side, forming one of said three sides, facing the inner periphery of the refiner segment. The curved side have a concave curvature with regard to the inner periphery to thereby form a rounded section in an area defined by the dam and the corresponding pair of adjacent bars.

According to a second aspect of the proposed technology there is provided a refiner disc comprising a refiner segment according to the first aspect.

According to a third aspect of the proposed technology there is provided a refiner comprising a refiner disc according to the second aspect.

Embodiments of the proposed technology provides for a refiner segment, and a corresponding refiner disc and refiner, that better withstands the wear caused by the abrasive contact between dams and the material flowing on the refiner segment. This will in turn prolong the effective lifetime of the refiner segment.

Additional advantages will be appreciated when reading the detailed description.

BRIEF DESCRIPTION OF THE DRAWINGS

The embodiments, together with further objects and advantages thereof, may best be understood by making reference to the following description taken together with the accompanying drawings, in which.

DETAILED DESCRIPTION

Throughout the drawings, the same reference designations are used for similar or corresponding elements.

Generally, all terms used herein are to be interpreted according to their ordinary meaning in the relevant technical field, unless a different meaning is clearly given and/or is implied from the context in which it is used. All references to a/an/the element, apparatus, component, means, step, etc. are to be interpreted openly as referring to at least one instance of the element, apparatus, component, means, step, etc., unless explicitly stated otherwise. The steps of any methods disclosed herein do not have to be performed in the exact order disclosed, unless a step is explicitly described as following or preceding another step and/or where it is implicit that a step must follow or precede another step. Any feature of any of the embodiments disclosed herein may be applied to any other embodiment, wherever appropriate. Likewise, any advantage of any of the embodiments may apply to any other embodiments, and vice versa. Other objectives, features and advantages of the enclosed embodiments will be apparent from the following description.

For a better understanding of the proposed technology, it may be useful to begin with a brief description of a general refiner and a short analysis of the technical problems that the proposed technology aims to alleviate.

Figure 1:
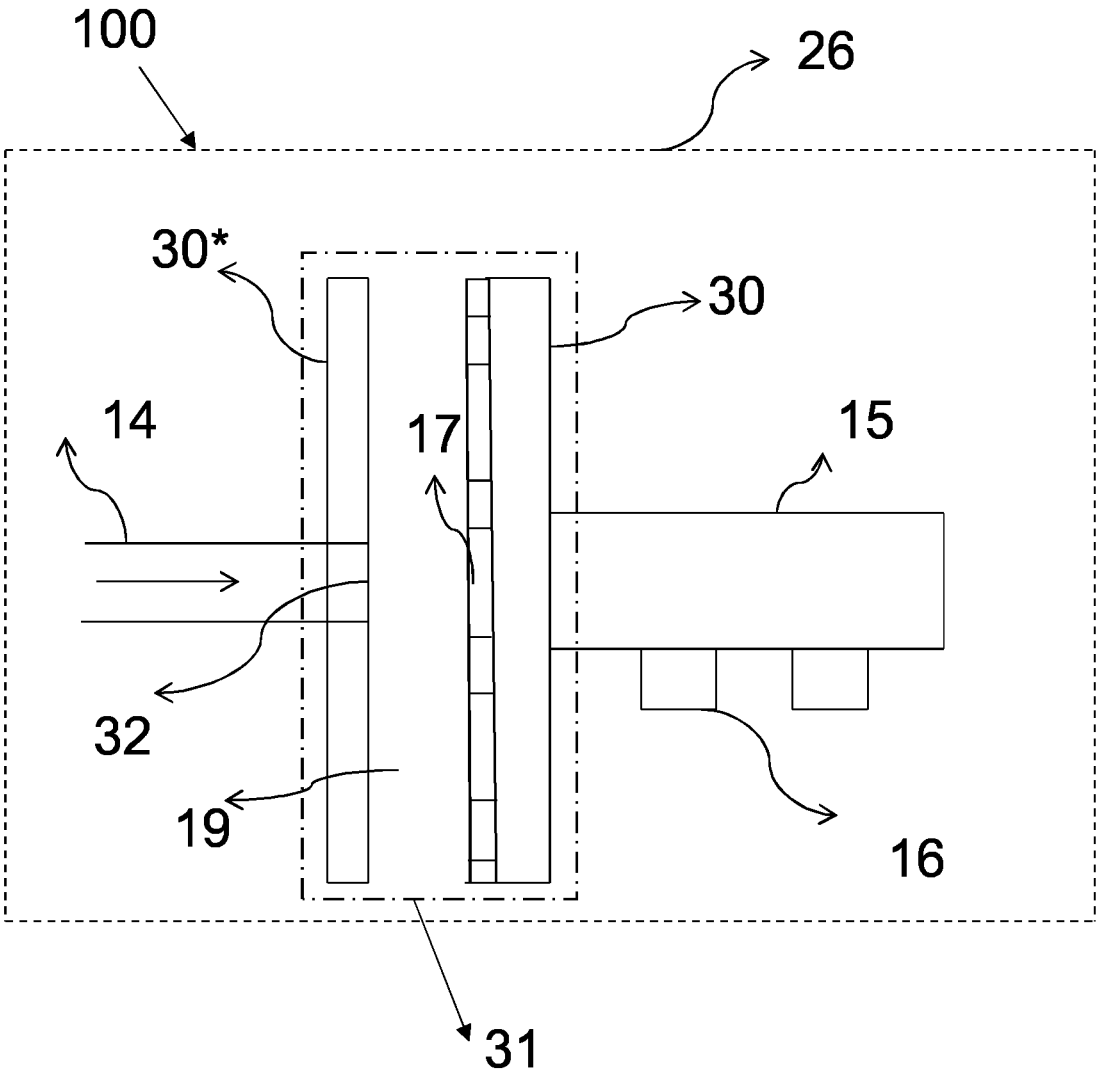
FIG. 1 is a schematic illustration of a refiner wherein the refiner segment according to the proposed technology may be used.

To this end reference is made to FIG. 1 which schematically illustrates a refiner that can utilize the proposed technology. FIG. 1 shows schematically an exemplary pulp refiner 100 in a cross-sectional view. The arrangement is housed in a housing 26 that represents the outer casing of the refiner device together with all components of the device that is not essential for understanding the present invention. Examples of components not shown are an electrical motor for driving e.g. the rotation shaft, the feeding mechanism for the lignocellulosic material etc. Inside a second housing 31 a rotor refiner disc 30 and a stator refiner disc 30* is linearly aligned along a shaft. The rotor refiner disc 30 and the stator refiner disc 30* will in what follows be referred to as a rotor and stator, respectively. The rotor 30 is attached to a rotation shaft 15 arranged on bearings 16. The rotation shaft 15 is connected to a motor, not shown, that rotates the shaft 15, and thus the rotor 30. The stator 30* facing the rotor 30 can be provided with a centrally located through hole 32 that extends between a feeding channel 14 for lignocellulosic material and a refining area 19. The rotor 30 can in certain embodiments be provided with a center plate 17 having a surface facing the incoming flow of lignocellulosic material. The surface of the center plate 17 can be provided with structures that will direct the lignocellulosic material outwards. The rotor 30* and/or the stator 30 are provided with refiner segments to enable steering and grinding of the pulp. These refiner segments can be provided with bars and dams.

During use, lignocellulosic material such as wood chips or prepared wood, e.g., pulp, will be fed by means of a feeding mechanism, not shown, through the feeding channel 14. The material will pass through the hole 32 in the stator 30* and enter an area 19. The area 19 is essentially defined by the open area between the rotor 30 and the stator 30* and this area can be quite small during operation. The lignocellulosic material flowing into the area 19 will be incident on the center plate 17 on the rotor 30. The center plate 17 acts to steer the lignocellulosic material out towards the refiner segments on the rotor and/stator.

Figure 2:
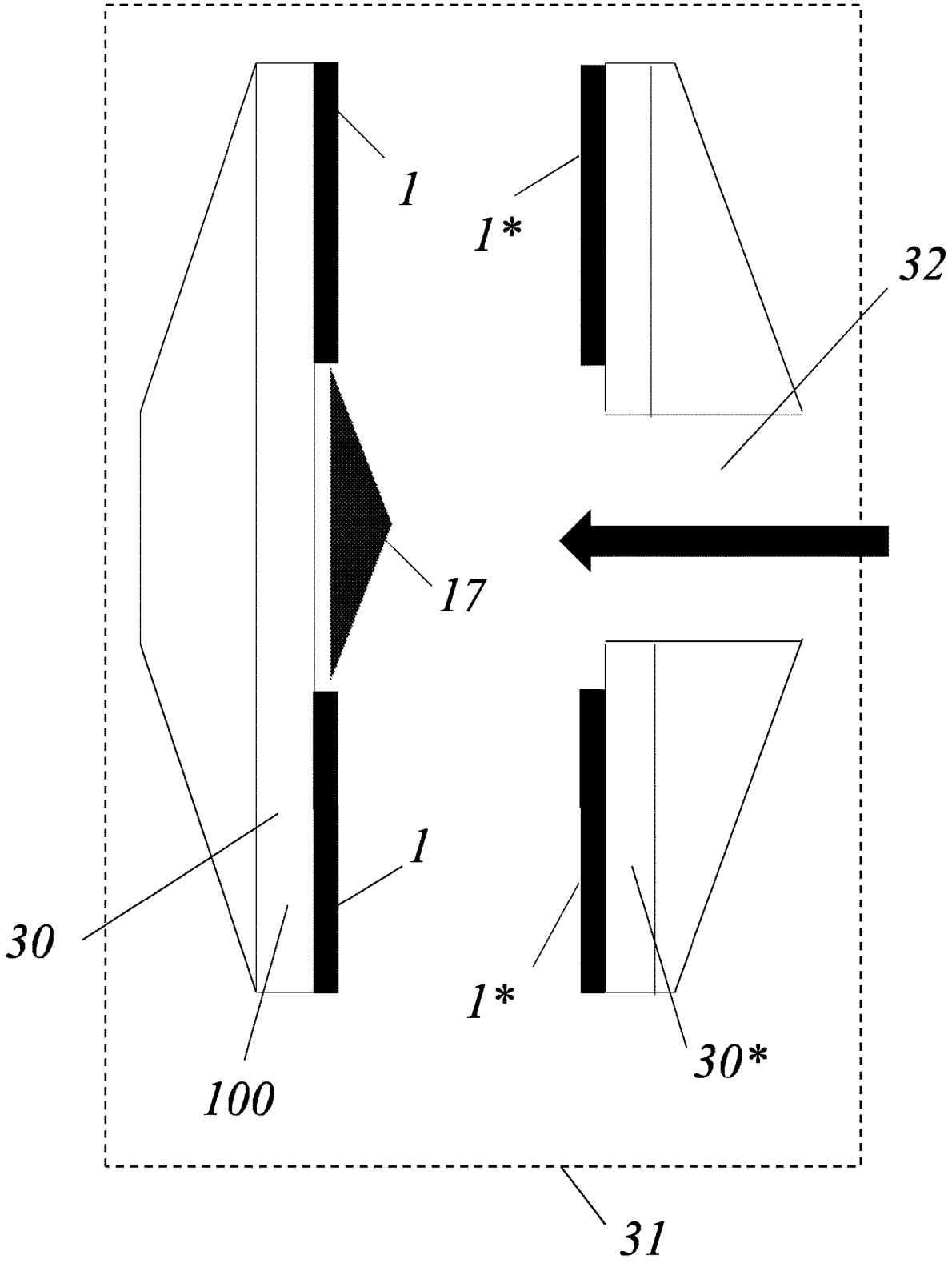
FIG. 2 is a schematic illustration of the cross-section of a refiner disc arrangement wherein the refiner segment according to the proposed technology may be used
Figure 7:
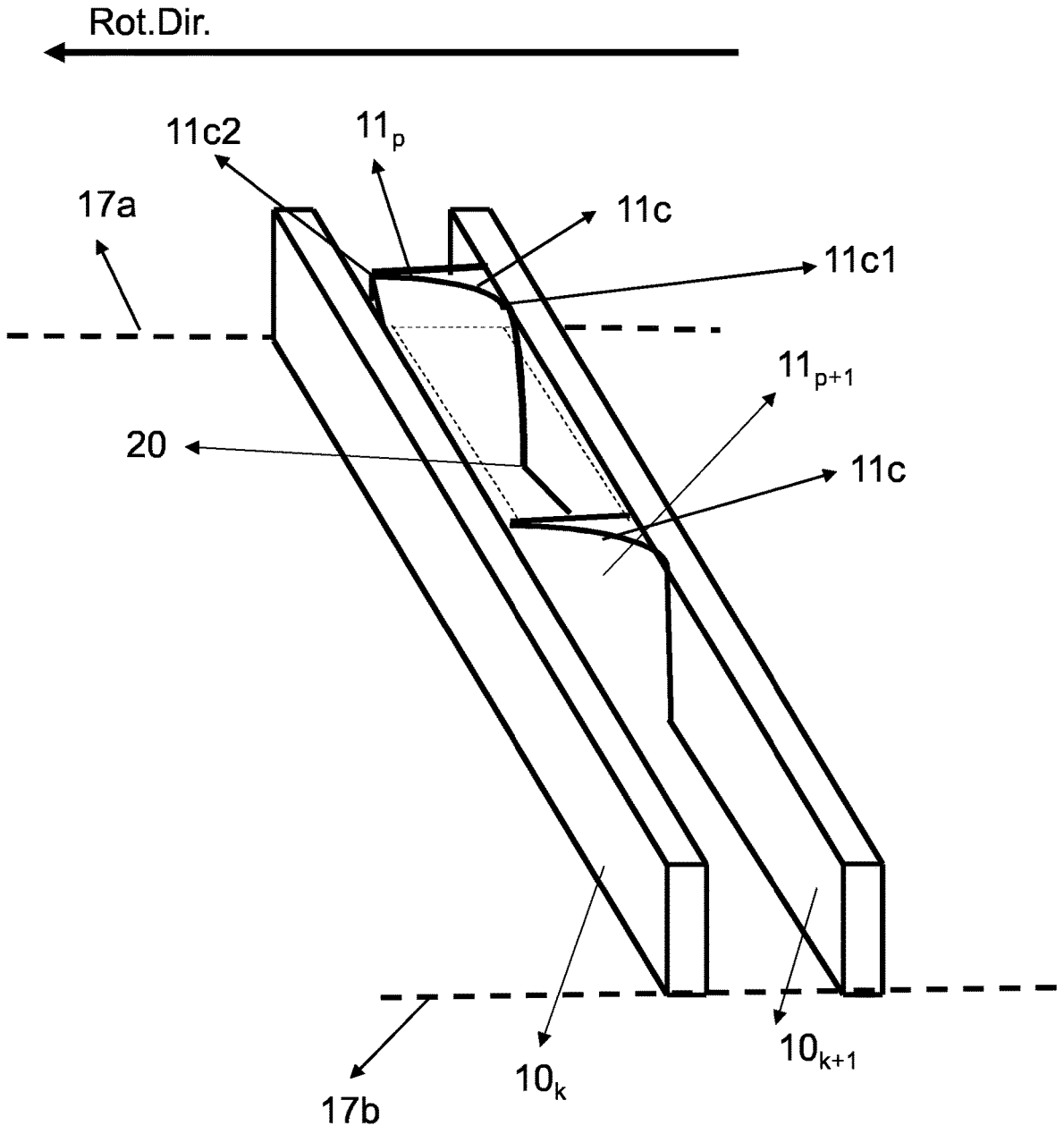
FIG. 7 is a schematic perspective view of a particular embodiment of a refiner segment according to the proposed technology

In order to provide a more detailed description of a rotor-stator arrangement in which the proposed technology may be used reference is made to FIG. 2. FIG. 2 illustrates a cross-sectional side view of a rotor-stator arrangement housed in a housing 31 in a refiner as e.g., described above. Shown is a rotor that is arranged to rotate around a rotation shaft. The rotor is provided, on the surface facing the stator, with a refiner disc comprising a refiner segment 1. The stator is provided, on the surface facing the rotor, with a refiner disc 30* comprising a refiner segment 1*. The refiner discs may in certain versions of a refiner be referred to as a segment holders since one of the purposes of the refiner discs are to carry refiner segments 1, 1*. Also illustrated in FIG. 7 is an inlet 32 for the lignocellulosic material subject to refining. The inlet 32 is arranged in the central area of the stator. Arranged in the center area of the refiner disc on the rotor side, opposing the inlet 32, is a center plate 17. The purpose of the center plate 17, which was described above with reference to FIG. 1, is to distribute material that falls in from the inlet 32 towards the outer sections of the refiner disc. That is, the center plate 17 acts to distribute the material towards the refiner segments arranged on the refiner discs.

Figure 3:
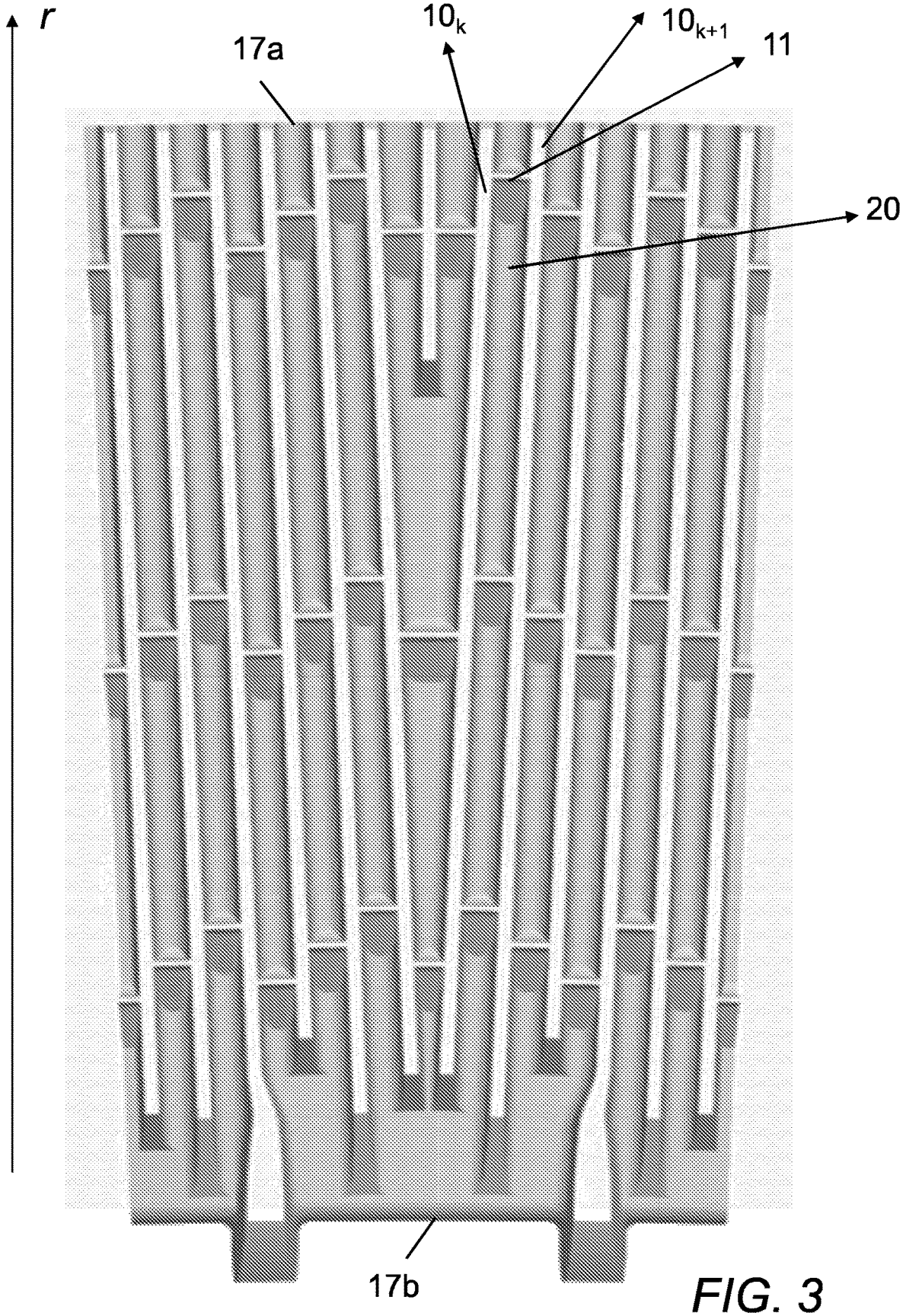
FIG. 3 is a schematic illustration of a known refiner segment as viewed from above.

Having described in detail a general refiner that can utilize the proposed technology, we will proceed and describe in detail a particular known refiner segment that is relevant for the proposed technology. To this end reference is made to FIG. 3. FIG. 3 provides a schematic illustration of a refiner segment 1. The refiner segment 1 consists in this particular example of a circular sector. There are other versions of refiner segments, the proposed technology however functions equally well for all particular refiner segment shapes. The refiner segment 1 is provided in the shape of a segment to be attached to a refiner disc 30. A refiner segment may be provided in the shape of a circle, optionally with a removed central area, or in the shape of a circle sector. A refiner disc 30 may thus be provided with a number of refiner segments 1 whereby it will either be completely covered by refiner segments 1 or partially covered. The refiner segment may in particular form part of a rotor disc or equivalently a rotor refiner disc. In case the refiner segment 1 form part of a rotor refiner disc, the center area of the rotor refiner disc may comprise a center plate. FIG. 3 illustrates a refiner segment having an inner periphery 17*b* and an outer periphery 17*a*. The inner periphery 17*b* are the periphery of the refiner segment that is intended to be closest to the center of the refiner disc 30 when the refiner segment has been attached thereto. The refiner segment is also provided with a number of radially extending bars 10 that run in a nearly parallel fashion along the active surface, i.e., the surface facing the material flow, of the refiner segment. Also shown is a number of dams 11 that are orthogonally directed with regard to the bars 10, and where each dam 11 connects to both bars 10 in a pair of adjacent bars 10. The arrangement of bars and dams defines a partially bounded section 20.

Figure 4:
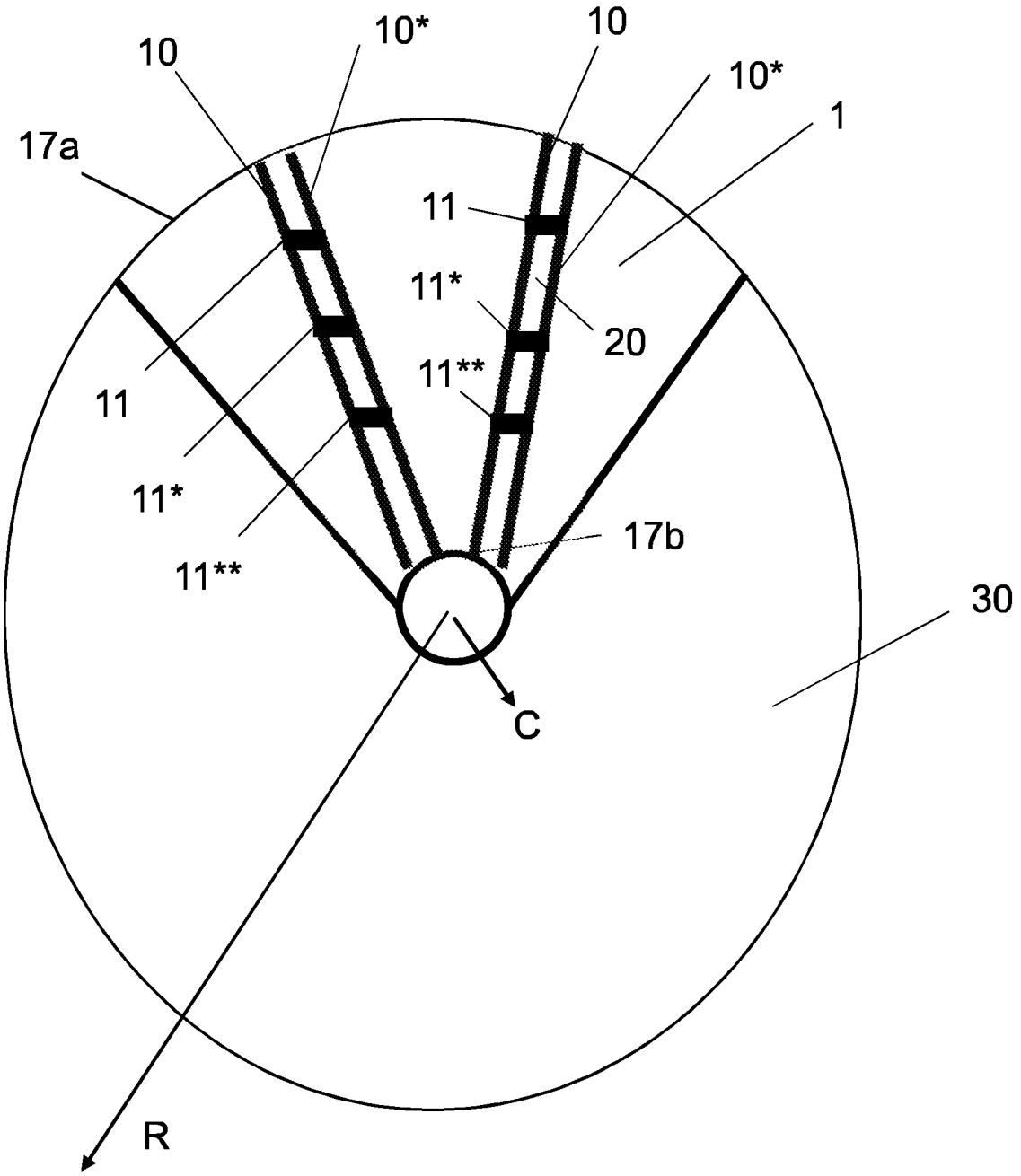
FIG. 4 is a schematic illustration of a known refiner segment attached to a refiner disc such a rotor disc or a stator disc.

FIG. 4 is a simplified view of part of the refiner segment 1 in FIG. 3. The refiner segment 1 is in this particular drawing attached to a circular refiner disc 30, e.g., a stator or a rotor, having a center C. The radial direction is illustrated by means of an arrow denoted R. The radial direction extends from the center of the disc toward the periphery of the disc, passing on its way through the inner 17*b* and outer 17*a* peripheries of the refiner segment. The schematic drawing illustrates in detail two sets of adjacent and neighbouring bars 10, 10*. Each of the bars in an adjacent sets of bars are connected to each other by means of dams 11, 11* and 11. The dams extend between the adjacent bars in an approximately orthogonal direction with regard to the radial extension of the bars. In this way a partially open area 20 is created, i.e., bounded, by the adjacent bars 10, 10* and a corresponding dam 11**. During use of the refiner segment the main part of the material will flow in areas such as these. When the material flows towards the periphery of the refiner segment it will impinge on dams and be lifted up towards the disc gap, as was explained earlier. The interaction between the flowing material and the dams will cause a lot of wear on the dams and may in time destroy at least part of them thereby rendering the refiner segment less effective since the intended material lifting action will be partially lost. The aim of the proposed technology is to provide mechanisms that improve the refiner segments resilience against wear caused by the abrasive contact between the material flow and the dams.

The proposed technology provides a refiner segment 1 for refining of lignocellulosic material. The refiner segment 1 having a surface comprising a plurality of bars $\mathbf{10}_j$ extending along a direction between an inner periphery 17*b* of the refining segment and an outer periphery 17*a* of the refining segment 1, and a plurality of dams $\mathbf{11}_i$, where each of the dams extend between a corresponding pair of adjacent bars $\mathbf{10}_k$, $\mathbf{10}_{k+1}$. At least one of the dams $\mathbf{11}_p$ is a three-dimensionally extending body comprising three sides. The three dimensionally extending body extend between the corresponding pair of adjacent bars $\mathbf{10}_k$, $\mathbf{10}_{k+1}$ and comprises a curved side 11*c*, forming one of the three sides, and facing the inner periphery 17*b* of the refiner segment 1. The curved side 11*c* have a concave curvature with regard to the inner periphery 17*b*, i.e., as viewed from said periphery 17*b*, to thereby form a rounded section in an area 20 defined by the dam $\mathbf{11}_p$ and the corresponding pair of adjacent bars $\mathbf{10}_k$, $\mathbf{10}_{k+1}$.

The proposed refiner segment is provided with a dam construction where a dam is provided as a three dimensionally extending body that comprises three sides where one side, i.e., the side facing the incoming material, is curved or rounded with regard to the periphery 17*b*. That is, it is curved in a concave fashion when viewed from the periphery 17*b*, this can be seen in e.g., FIGS. 5, 6 and 7. The features of such a refiner segment ensures that a dam is built up by a lot of extra material, something that provides additional protection against wear. The dam is also provided with a rounded side that is adapted to face the incoming material, thus ensuring a reduced wear when the abrasive material comes in contact with the dam.

Taken together these features ensures that a dam is very robust against wearing caused by the interaction between the flowing material and the dam.

The three dimensionally extending dam $\mathbf{11}_p$ is provided on the refining surface of the refiner segment and may be provided in various shapes, it may for example have the shape of a three dimensional wedge or block where one of the sides, the side facing the incoming material, is curved or rounded. Such a three dimensionally extending dam $\mathbf{11}_p$ is illustrated in FIG. 7. The curved side facing the incoming material is denoted 11*c*. The dam is also provided with a side opposite the curved side and a side facing upwards, in a direction normal to the refining surface of the refiner segment.

Figure 5:
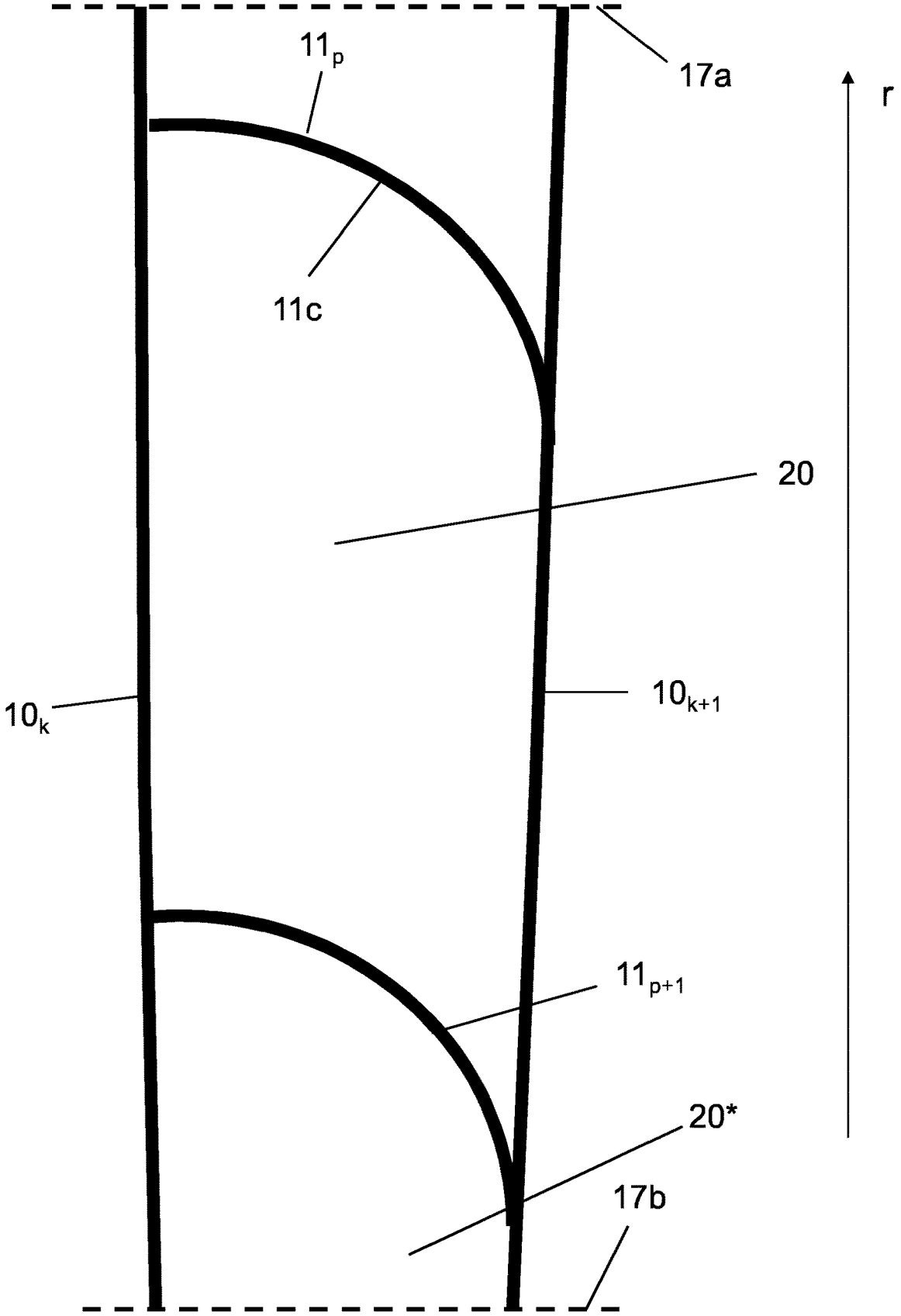
FIG. 5 is a schematic illustration from above of part of a refiner segment according to the proposed technology.

FIG. 5 provides an example of part of a refiner segment 1 for refining of lignocellulosic material. The refiner segment 1 having a surface comprising a plurality of bars $\mathbf{10}_j$ extending along a direction between an inner periphery 17*b* of the refiner segment and an outer periphery 17*a* of the refiner segment 1. The surface also comprises a plurality of dams $\mathbf{11}_i$, i=1, 2, . . . p, p+1, . . . N, where each of the dams extends between a corresponding pair of adjacent bars $\mathbf{10}_k$, $\mathbf{10}_{k+1}$. At least one of the dams $\mathbf{11}_p$ on the refiner segment 1 comprises a curved side 11*c* facing the inner periphery 17*b* of the refiner segment 1. The curved side 11*c* have a concave curvature with regard to the inner periphery 17*b* to thereby form a rounded section in an area 20 defined by the dam $\mathbf{11}_p$ and the corresponding pair of adjacent bars $\mathbf{10}_k$, $\mathbf{10}_{k+1}$. Before describing FIG. 5 in detail we briefly explain the reference notation used. The proposed technology provides a refiner segment comprising a plurality of dams. The total number of dams may for example be denoted N. The index i used in the notation $\mathbf{11}_i$ runs over all integers from 1 up to N. i.e., i=1, 2, . . . p, p+1, . . . N. Specific dams are thus denoted by the reference numeral $\mathbf{11}_1$, $\mathbf{11}_2$, . . . $\mathbf{11}_p$, etc. The proposed technology also provides a refiner segment comprising a plurality of bars. The total number of bars may for example be denoted M, M may be equal to N but is not in general. The index used in the notation $\mathbf{10}_j$ runs over all integers from 1 up to M. i.e., i=1, 2, . . . k, k+1, . . . M. Specific bars may thus be denoted by the reference numeral $\mathbf{10}_1$, $\mathbf{10}_2$, . . . $\mathbf{10}_k$, etc. Returning to FIG. 5 where there is shown a highly simplified view from above of a bar and dam arrangement on a refiner segment according to the proposed technology. FIG. 5 illustrates a specific dam $\mathbf{11}_p$ that extend between two radially extending bars $\mathbf{10}_k$ and $\mathbf{10}_{k+1}$. The dam $\mathbf{11}_p$ comprises a curved side 11*c* having a concave curvature with regard to the inner periphery 17*b* of the refiner segment 1. The concave curvature creates a rounded section in the area 20 that is bounded by the pair of bars $\mathbf{10}_k$; $\mathbf{10}_{k+1}$ and the dam $\mathbf{11}_p$. The inventor has discovered that the rounded section obtained by the curved side 11*c* of the dam $\mathbf{11}_p$ renders the refiner segment less prone to wear caused by material flowing through the area 20.

Some of the embodiments contemplated herein will now be described more fully with reference to the accompanying drawings. Other embodiments, however, are contained within the scope of the subject matter disclosed herein, the disclosed subject matter should not be construed as limited to only the embodiments set forth herein; rather, these embodiments are provided by way of example to convey the scope of the subject matter to those skilled in the art.

Figure 6:
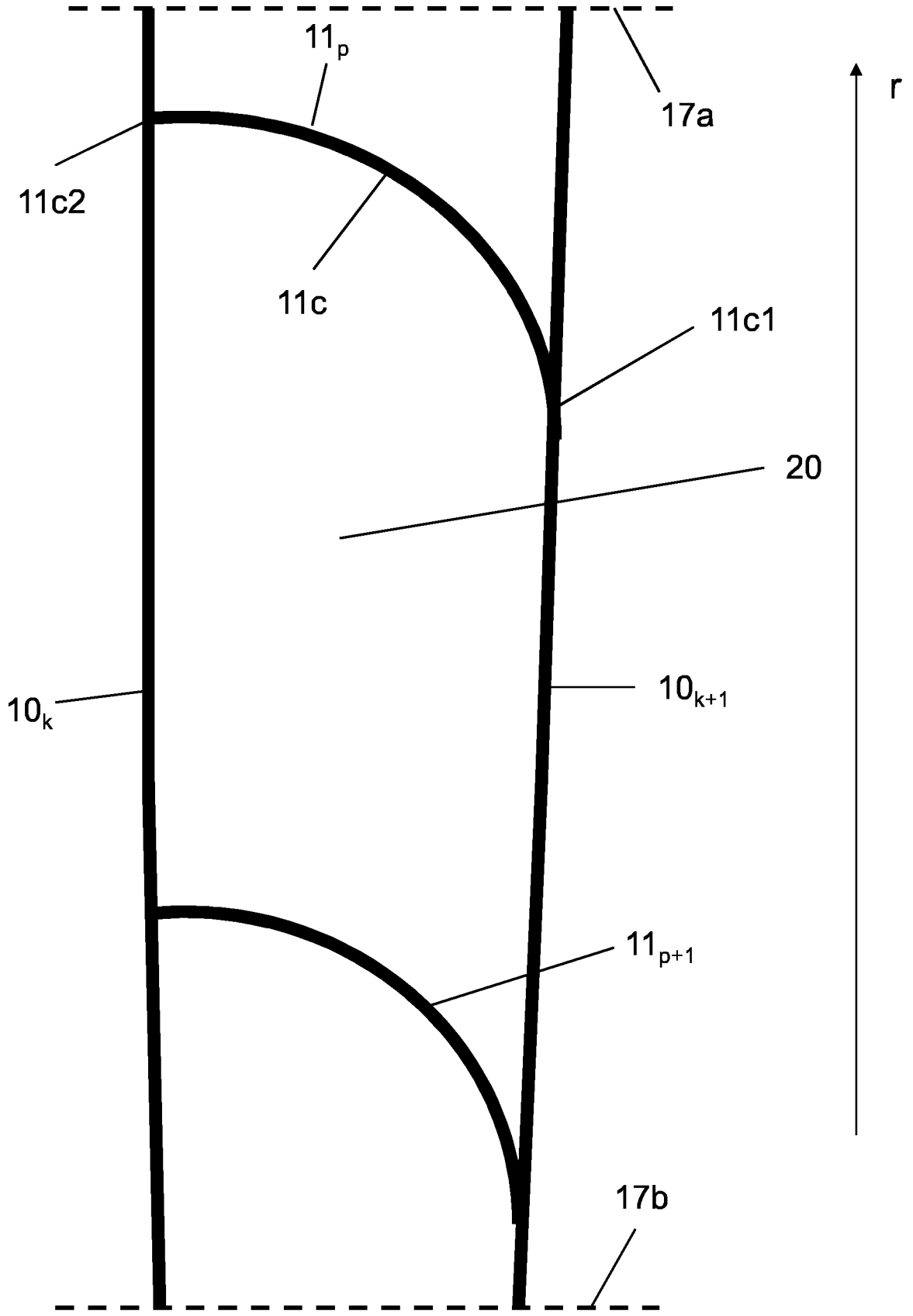
FIG. 6 is a schematic illustration from above of a particular embodiment of a refiner segment according to the proposed technology.

A particular embodiment of the proposed technology provides a refiner segment 1 wherein a first end 11*c*1 of the curved side 11*c* connects to a bar $\mathbf{10}_k$ at a radial position that is closer to the inner periphery 17*b* of the refiner segment 1 than the radial position where a second end 11*c*2 of the curved side 11*c* connects to an adjacent bar $\mathbf{10}_{k+1}$ to thereby form a rounded section in the form of a rounded corner. FIG. 6 provides a schematic and simplified illustration from above of a single bar and dam arrangement according to this particular embodiment. The embodiment provides in particular for a refiner segment 1, wherein the first end 11*c*1 of the dam is a trailing end and said second end 11*c*2 of the dam is a leading end with regard to the intended rotational direction of the refining segment. A refiner segment with this arrangement acts to ensure that the main part of material flow on the refiner segment 1 mainly contacts the rounded section of the dam upon rotation of the refiner segment 1. Since the rounded section better withstands wear caused by the interaction with the material a more robust refiner segment is obtained.

Figure 8:
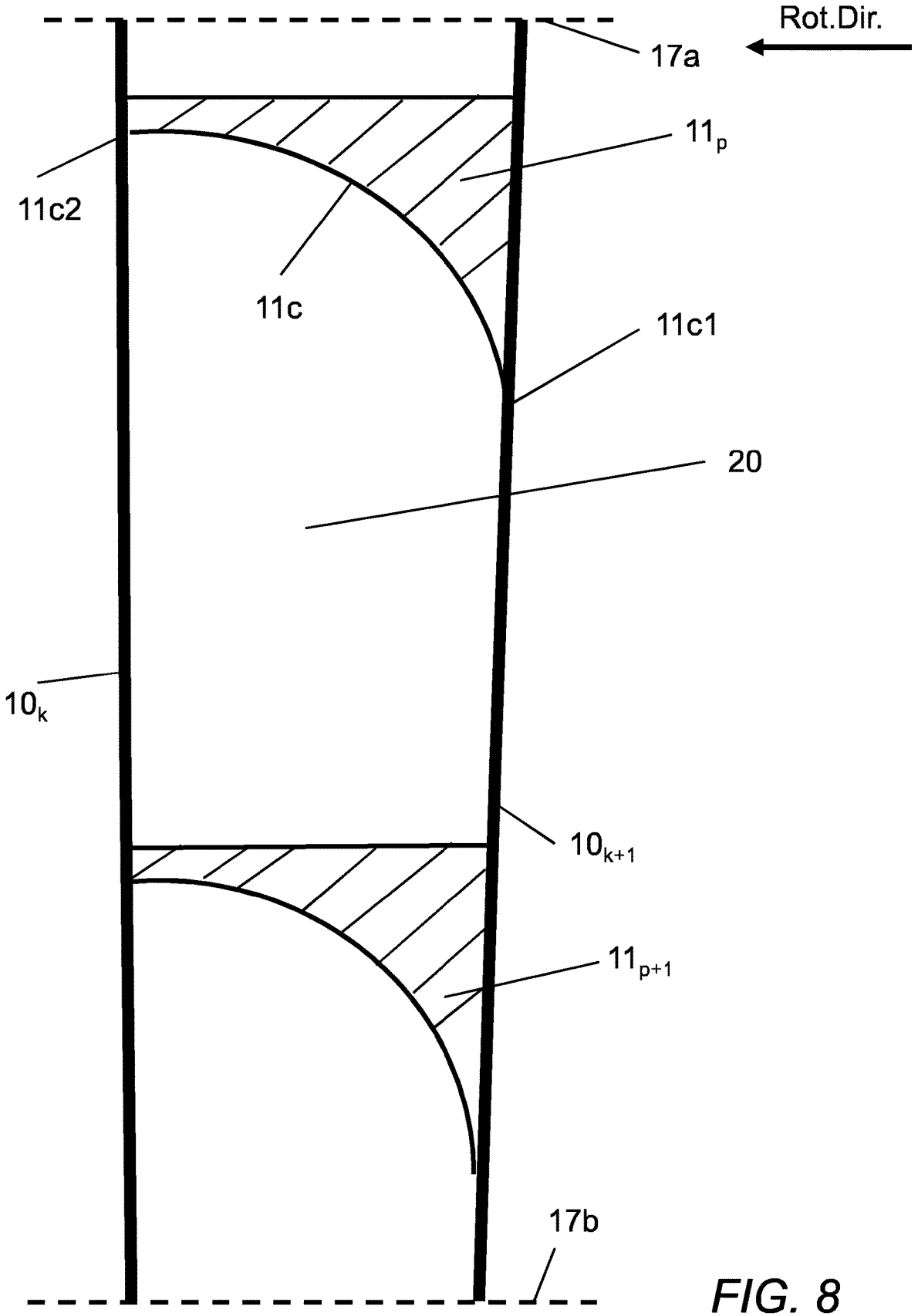
FIG. 8 is a schematic illustration from above of the particular embodiment illustrated in FIG. 7.

Still another embodiment of the proposed technology provides a refiner segment 1 wherein the dam comprises a three dimensionally extended body and the curved side 11*c* of the dam comprises an outer surface of the three dimensional body facing the inner periphery of the segment. A particular version of this embodiment provides a refiner segment 1, wherein at least one dam $\mathbf{11}_p$ is a three-sided body extending between the corresponding pair of adjacent bars $\mathbf{10}_k$, $\mathbf{10}_{k+1}$ and wherein the curved side 11*c* form one side of the three-sided body. FIG. 7 provides a perspective view of such an embodiment. It is shown how a three dimensionally extended first dam $\mathbf{11}_p$ extends between two adjacent bars $\mathbf{10}_k$ and $\mathbf{10}_{k+1}$. The bars extend along the total distance between the inner periphery 17*b* and the outer periphery 17*a* in this example, there are however embodiments where they only extend part of the distance between the inner periphery 17*b* and the outer periphery 17*a*. A first end 11*c*1 of the dam is arranged closer to the inner periphery of the dam than the opposite second end 11*c*2. The second end 11*c*2 is in this example, with the intended rotational direction shown, the leading end while the first end 11*c*1 is the trailing end. One side of the three dimensionally extended first dam $\mathbf{11}_p$ comprises a curved side 11*c* that is facing the inner periphery 17*b* of the refiner segment. The curved side 11*c* have a concave curvature when viewed from the inner periphery 17*b*. The illustrated dam with the curved side forms a rounded corner in the area 20, this rounded corner is, by construction, arranged so that it faces most of the material flow when the refiner segment is rotated with the rotation direction illustrated by the arrow, i.e., counter-clockwise. The pair of adjacent bars $\mathbf{10}_k$ and $\mathbf{10}_{k+1}$ also comprises an additional dam $\mathbf{11}_{p+1}$ having the same purpose, but arranged closer to the inner periphery 17*b*. FIG. 8 also give an illustration this embodiment but when viewed from above. FIG. 8 illustrates how a first end 11*c*1 of the curved side 11*c* of the three-sided body connects to a bar $\mathbf{10}_k$ at a radial position that is closer to the inner periphery 17*b* of the refiner segment 1 than the radial position where a second end 11*c*2 of the curved side 11*c* connects to an adjacent bar $\mathbf{10}_{k+1}$ to thereby form a rounded section in the form of a rounded corner in the partially bounded area 20.

Yet another embodiment of the proposed technology provides a refiner segment 10 wherein each pair of adjacent bars $\mathbf{10}_k$, $\mathbf{10}_{k+1}$ comprises a plurality of dams $\mathbf{11}_p$, each having a curved side, where individual dams $\mathbf{11}_p$ are arranged at different radial positions along the pair of adjacent bars $\mathbf{10}_k$, $\mathbf{10}_{k+1}$. FIGS. 5-8 provides schematic illustrations of such an embodiment. In the simplified drawings in FIGS. 5-8 it is shown how two dams $\mathbf{11}_p$ and $\mathbf{11}_{p+1}$, each having a curved side 11*c*, extend between the adjacent bars $\mathbf{10}_k$, $\mathbf{10}_{k+1}$ at different radial locations. Different radial locations may for example be defined with regard to the inner periphery 17*b* of the refiner segment. A refiner segment where a specific pair of adjacent bars $\mathbf{10}_k$, $\mathbf{10}_{k+1}$ comprises several dams $\mathbf{11}_p$, $\mathbf{11}_{p+1}$, $\mathbf{11}_{p+2}$ . . . will create several separate areas 20 that are defined by the corresponding pair of adjacent bars $\mathbf{10}_k$, $\mathbf{10}_{k+1}$ and the dams. In FIG. 5 it is for example shown how an area 20 is defined by the adjacent bars $\mathbf{10}_k$, $\mathbf{10}_{k+1}$ and the dams $\mathbf{11}_p$, $\mathbf{11}_{p+1}$. There is also shown how an area 20* is defined by the adjacent bars $\mathbf{10}_k$, $\mathbf{10}_{k+1}$ and the dam $\mathbf{11}_{p+1}$. The area 20* may terminate at the inner periphery 17*b* of the refiner segment but it may also be bounded by an additional dam $\mathbf{11}_{p+2}$, which is not shown. The areas 20 may thus be bounded by a single dam and two adjacent bars in order to have an open channel towards the inner 17*b* or outer 17*a* periphery but it may also be bounded by two dams and two adjacent bars in order to create a box shaped area 20. The area is however open in the upward direction in order to be able to lift the material flow towards the disc gap defined as the gap between two relatively rotating refiner discs. According to a particular embodiment of the proposed technology which relates to the case where the area 20 is defined by adjacent bars $\mathbf{10}_k$, $\mathbf{10}_{k+1}$ and dams $\mathbf{11}_p$, $\mathbf{11}_{p+1}$ arranged at different radial positions, the relative distance D, in the radial direction, between the first end 11*c*1 of the curved side 11*c* and the second end 11*c*2 of the curved side 11*c* may for example be 1-30% of the length of the area 20 between the dam $\mathbf{11}_p$ and the dam $\mathbf{11}_{p+1}$. More preferably between 1-20% of the length of the area 20 between the dam $\mathbf{11}_p$ and the dam $\mathbf{11}_{p+1}$. This is illustrated in FIG. 5.

It should be noted that all of the dams on a refiner segment may be provided in the curved form proposed in the present disclosure, but it is also possible to provide only a subset of the dams with this feature. A particular example is provided by a refiner segment 1, wherein at least a radial midsection of the refiner segment 1 is equipped with dams $\mathbf{11}_p$ having a curved side 11*c*. This embodiment provides a refiner segment where dams arranged in a central band of the segment is provided with a curved side in order to at least provide additional resilience against wear in this active area of the refiner segment. The radial midsection or the central band of the refiner segment may for example be defined in relation to the inner periphery 17*b* of the refiner segment.

According to an additional aspect of the proposed technology there is provided a refiner segment 1 that is to be attached to a circular refiner disc 30 of a refiner so that the curved side 11*c* faces the center of the circular refiner disc 30 and have a concave curvature with regard to the center C of the refiner disc whereby a rounded section is facing a material flow directed from the center C of the refiner disc towards the periphery of the refiner disc 30. The refiner disc 30 may in particular be either a rotor disc or a stator disc.

According to yet another aspect of the proposed technology there is provided a refiner 100 for refining of lignocellulosic material, the refiner comprising at least one refiner disc 30 comprising a refiner segment 1 according to what has been described earlier.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A refiner segment for refining lignocellulosic material, the refiner segment having a surface comprising a plurality of bars extending along a direction between an inner periphery of the refiner segment and an outer periphery of the refiner segment, and a plurality of dams, each of the plurality of dams extending between a corresponding pair of adjacent bars among the plurality of bars, wherein at least one of the plurality of dams is a three-dimensionally extending body comprising three sides, the three-dimensionally extending body extends between the corresponding pair of adjacent bars and comprises a curved side, forming one of the three sides, facing the inner periphery of the refiner segment, the curved side having a concave curvature with regard to the inner periphery to thereby form a rounded section in an area defined by the at least one of the plurality of dams and the corresponding pair of adjacent bars.

2. The refiner segment according to claim 1, wherein a first end of the curved side connects to a first bar of the corresponding pair of adjacent bars at a first radial position that is closer to the inner periphery of the refiner segment than a second radial position where a second end of the curved side connects to a second bar of the corresponding pair of adjacent bars, to thereby form the rounded section in the form of a rounded corner.

3. The refiner segment according to the claim 2, wherein the first end is a trailing end and the second end is a leading end with regard to an intended rotational direction of the refiner segment.

4. The refiner segment according to claim 1, wherein each corresponding pair of adjacent bars comprises several of the plurality of dams, each having a curved side, where individual ones of the several dams are arranged at different radial positions along the corresponding pair of adjacent bars.

5. The refiner segment according to claim 1, wherein at least a radial midsection of the refiner segment is equipped with one of the plurality of dams having a curved side.

6. The refiner segment according to claim 1, wherein:

the refiner segment is configured to be attached to a circular refiner disc of a refiner so that the curved side faces a center of the circular refiner disc, and the concave curvature of the curved side is concave with regard to the center of the circular refiner disc so that the rounded section faces a material flow directed from the center of the circular refiner disc towards an outer periphery of the circular refiner disc.

7. A refiner disc comprising the refiner segment according to claim 6.

8. The refiner disc according to claim 7, wherein the refiner disc is a rotor disc or a stator disc.

9. A refiner for refining lignocellulosic material, the refiner comprising the refiner disc according to claim 7.

* * * * *